United States Patent [19]

Taniguchi

[11] Patent Number: 4,608,579

[45] Date of Patent: Aug. 26, 1986

[54] THERMOSENSITIVE RECORDING MATERIAL

[75] Inventor: Keishi Taniguchi, Shizuoka, Japan

[73] Assignee: Ricoh Company, Ltd., Tokyo, Japan

[21] Appl. No.: 736,848

[22] Filed: May 22, 1985

[30] Foreign Application Priority Data

| | | | |
|---|---|---|---|
| May 25, 1984 | [JP] | Japan | 59-105781 |
| May 31, 1984 | [JP] | Japan | 59-112006 |
| Jun. 1, 1984 | [JP] | Japan | 59-112769 |
| Sep. 11, 1984 | [JP] | Japan | 59-190225 |
| Nov. 12, 1984 | [JP] | Japan | 59-237781 |
| Mar. 1, 1985 | [JP] | Japan | 60-41722 |

[51] Int. Cl.[4] ..... B41M 5/18

[52] U.S. Cl. ..... 346/209; 346/212; 346/216; 346/217; 346/221; 346/225; 346/226; 427/151; 427/152

[58] Field of Search ..... 346/212, 208, 209, 216, 346/217, 221, 225, 226, 150, 151, 152

[56] References Cited

U.S. PATENT DOCUMENTS

| | | | |
|---|---|---|---|
| 4,379,721 | 4/1983 | Qualitz et al. | 346/212 |
| 4,482,378 | 11/1984 | Riou et al. | 346/216 |
| 4,536,219 | 8/1985 | Riou et al. | 346/212 |

FOREIGN PATENT DOCUMENTS

| | | | |
|---|---|---|---|
| 0079551 | 7/1978 | Japan | 346/216 |
| 0032851 | 2/1985 | Japan | 346/217 |

*Primary Examiner*—Bruce H. Hess

*Attorney, Agent, or Firm*—Oblon, Fisher, Spivak, McClelland & Maier

[57] ABSTRACT

A thermosensitive recording material comprising a support material and a thermosensitive coloring layer formed thereon, in which thermosensitive coloring layer, colored images are formed by the reaction between a colorless or light-colored leuco dye and a color developer of the following formula capable of inducing color formation in the leuco dye upon application of heat thereto,

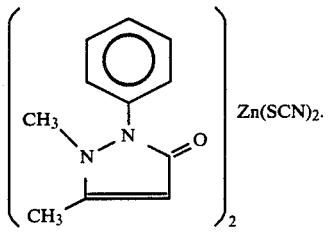

10 Claims, No Drawings

THERMOSENSITIVE RECORDING MATERIAL

BACKGROUND OF THE INVENTION

The present invention relates to a thermosensitive recording material which is, in particular, improved with respect to the stability of recorded images. The thermosensitive recording material comprises a support material and a thermosensitive color-forming layer formed on the support material, which thermosensitive color-forming layer comprises a leuco dye which is a colorless or light-colored at room temperature, the antipyrine complex of zinc thiocyanate (hereinafter referred to as the zinc thiocyanate antipyrine complex) which serves as a color developer capable of inducing color formation in the leuco dye upon application of heat thereto. When necessary, other auxiliary sensitizer agents can be used in combination with the zinc thiocyanate antipyrine complex.

Recently thermosensitive recording materials are employed in a variety of fields, for instance, for use with printers of computers, recorders of medical analytical instruments, facsimile apparatus, automatic ticket vending apparatus, and thermosensitive copying apparatus, since they have the following advantages over other conventional recording materials: (1) Images can be formed by simple heat application, without complicated steps for development; (2) the thermosensitive recording materials can be produced by a simple apparatus and the storage of the thermosensitive recording materials is simple and does not involve excessive costs; (3) as the support material of the thermosensitive recording materials, paper is usually used, which is rather inexpensive in comparison with other support materials, such as synthetic resin films, and when paper is used as the support material, the thermosensitive recording material has a pleasing plain-paper-like touch.

As such a thermosensitive recording material, there is proposed, for instance, in Japanese Patent Publications Nos. 43-4160 and 45-14039, a thermosensitive recording material which comprises a support material and a thermosensitive coloring layer containing a colorless or light-colored leuco dye including a lactone, lactam or spiropyran ring, and an acidic material such as an organic acid and a phenolic material which serves as a color developer capable of inducing color formation in the leuco dye upon application of heat thereto. This thermosensitive recording material, however, has the shortcoming that the recorded images become easily discolored or fade away when the recorded images come into contact with oils and a plasticizer, such as dioctyl phthalate, contained in plastic films.

Conventionally, a variety of thermosensitive coloring layers are proposed which are improved so as to increase the stability of the recorded images. For example, a thermosensitive coloring layer containing a large amount of a resin which is resistant to water and chemicals, a thermosensitive coloring layer containing a resin which becomes hard upon exposure to heat or light, and a thermosensitive coloring layer having a protective layer made of a resin on the surface thereof are proposed. These thermosensitive coloring layers, however, have the shortcomings that the processes for preparing them are complicated, the photosensitivities are low and the costs are high.

Japanese Laid-open Patent Application No. 48-51716 and Japanese Patent Publication No. 51-25174 disclose a pressure-sensitive recording material containing a color developer which is resistant to chemicals. This color developer can be used with the pressure-sensitive recording material. However, when it is used in a thermosensitive recording material, it has the shortcoming that the background area is colored in contact with a plasticizer, although colored image areas are stable to a plasticizer.

Japanese Laid-open Patent Application No. 59-11286 with an invention title of "Pressure-sensitive or Thermosensitive Recording Material" discloses a number of color developers. When they are used in thermosensitive recording materials, most of them provide poor-quality thermosensitive recording materials, with conspicuous fogging in the background. Furthermore, the background of such thermosensitive recording materials is colored when it comes into contact with plasticizers.

In accordance with the recent general demand for high speed and highly condensed recording, there is not only a great demand for a high speed thermosensitive recording apparatus, but also a demand for a thermosensitive recording material that is sufficiently compatible with the high speed thermosensitive recording apparatus so as to be capable of attaining high speed and highly condensed recording, in particular, for use in the previously mentioned fields.

Conventionally, thermosensitive recording materials for use in high-speed recording have been proposed, for instance, in Japanese Laid-Open Patent Application No. 53-39139, Japanese Laid-Open Patent Application No. 53-26139, Japanese Laid-Open Patent Application No. 53-5636, and Japanese Laid-Open Patent Application No. 53-11036. In those thermosensitive recording materials, thermo-fusible materials having a low melting point, such as a variety of waxes, fatty acid amides, alkylated biphenyls, substituted biphenyl alkanes, coumarinic acid derivatives, biphenyl amines, are added to the thermosensitive coloring layer as a sensitizer or as an agent for reducing the melting point of the thermosensitive coloring layer. When the above described sensitizer agents are employed, it is necessary that the sensitizer agent be melted prior to the coloring reaction. Therefore, in the high-speed recording by application of a small amount of thermal energy in an extremely short time, for instance, by heat-application impulses, a sufficiently high thermal response for practical use cannot be obtained. In addition to the above problem, in the above case, since the thermo-fusible materials are melted within the thermosensitive coloring layer, the accumulation of the melted thermo-fusible materials on a thermal head during an image recording process, trailing of the printed images and formation of ghost images are apt to occur. Furthermore, at high temperatures and high humidities, fogging also occurs in the background of thermosensitive recording material during storage. As a result, the contrast of the recorded images decreases during storage.

SUMMARY OF THE INVENTION

It is therefore an object of the present invention to provide an improved thermosensitive recording material which is substantially free from the problems of discoloration and fading of the developed colored images, even if the images come into contact with, for instance, oils, plasticizers contained in plastic films and other chemicals.

Another object of the present invention is to provide a thermosensitive recording material which is capable of yielding images with high density and high sharpness with high thermal response in a stable manner in high-speed recording, which images are stable at high temperatures and high humidities.

The above objects of the present invention can be attained by the thermosensitive recording material which comprises a support material and a thermosensitive color-forming layer formed on the support material, which thermosensitive color-forming layer comprises a leuco dye which is a colorless or light-colored at room temperature, the zinc thiocyanate antipyrine complex having the following formula, which serves as a color developer capable of inducing color formation in the leuco dye upon application of heat thereto:

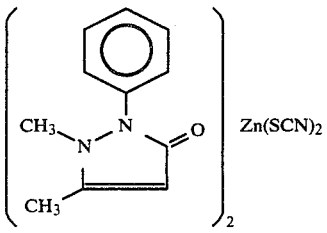

As the leuco dye, fluoran compounds having the general formula (I) and fluoran compounds having the general formula (II) are preferably employed:

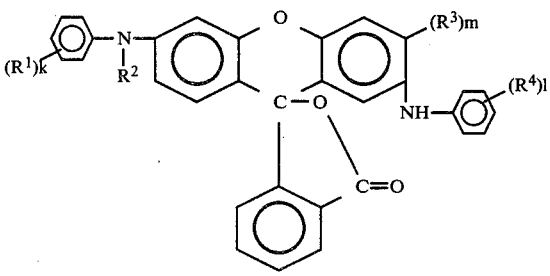

(I)

wherein $R^1$ and $R^2$ each represent an alkyl group having 1 to 6 carbon atoms, $R^3$ and $R^4$ each represent an alkyl group having 1 to 2 carbon atoms, or halogen, k and l each represent an integer of 0, 1 or 2, and m represents an integer of 0 or 1.

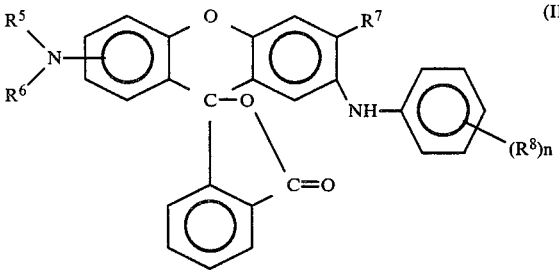

(II)

wherein $R^5$ and $R^6$ each represent an alkyl group having 1 to 8 carbon atoms, a cyclic hydrocarbon group having 1 to 8 carbon atoms, said alkyl group and said cyclic hydrocarbon groups can contain 1 to 3 ether bondings therein, $R^7$ represents hydrogen, an alkyl group having 1 to 2 carbon atoms, or halogen, $R^8$ represents hydrogen, an alkyl group having 1 to 6 carbon atoms, or halogen, and n represents an integer of 0, 1 to 5.

Other conventional fluoran compounds can also be employed as the leuco dye.

In order to improve the thermal response of the recording material and the stability of the recorded images, phenolic materials of the following formulas (III), (IV) and (V) can be employed in combination with the above zinc thiocyanate antipyrine complex:

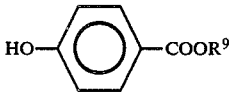

(III)

wherein $R^9$ represents an alkyl group having 1 to 7 carbon atoms, an unsubstituted or substituted phenyl group, or an unsubstituted or substituted benzyl group.

As the substituents of the phenyl group and the benzyl group, for instance, halogen, an alkoxy group, an alkyl group and a halomethyl group can be given.

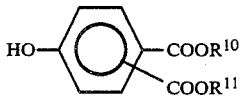

(IV)

wherein $R^{10}$ and $R^{11}$ each represent an alkyl group having 1 to 7 carbon atoms, an unsubstituted or substituted phenyl group, or an unsubstituted or substituted benzyl group and $R^{10}$ and $R^{11}$ can be the same or different.

As the substituents of the phenyl group and the benzyl group, for instance, halogen, an alkoxy group, an alkyl group and a halomethyl group can be given.

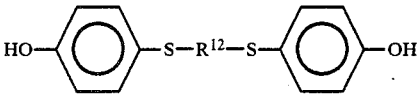

(V)

wherein $R^{12}$ represents an alkylene group having 2 to 10 carbon atoms, the alkylene group containing 1 to 3 ether bonds.

In order to improve the image density with highly white background, the thermal response of the recording material, the resistance of the recorded images to water, oils plasticizers and other chemicals, the diester compounds of the following formulas (VI) and (VII) can be employed in combination with the above zinc thiocyanate antipyrine complex:

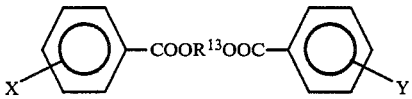

(VI)

wherein $R^{13}$ represents an alkylene group, a cycloalkylene group, a substituted or unsubstituted arylene group, or —$R^{16}$—Ar—$R^{17}$—(in which $R^{16}$ and $R^{17}$ each represent a lower alkyl group and Ar represents an unsubstituted or substituted arylene group), X and Y each represent hydrogen, a lower alkyl group, halogen or an alkoxy group, and X and Y can be the same or different.

In the above formula, the alkylene group has 1 to 10 carbon atoms. Examples of the alkylene group are methylene, ethylene, propylene, hexamethylene and decamethylene. The cycloalkylene group is, for example, cyclohexyl. Examples of the arylene group are two valence aromatic groups such as a phenylene group and a naphthylene group. Substituents of the arylene group are, for example, halogen and an alkoxy group.

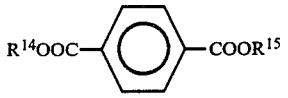

(VII)

wherein $R^{14}$ and $R^{15}$ each represent an alkyl group, a cycloalkyl group, a substituted or unsubstituted aryl or aralkyl group, and $R^{14}$ and $R^{15}$ can be the same or different.

In the above formula, examples of the alkyl group are lower alkyl groups such as methyl, ethyl, propyl, butyl, hexyl and octyl. The cycloalkyl group is, for example, cyclohexyl. Examples of the aryl group are phenyl, tolyl, xylyl, biphenyl and naphthyl. Examples of the aralkyl group are benzyl and phenethyl. Substituents of the aryl group and the aralkyl group are, for example, halogen and alkoxy.

DETAILED DESCRIPTION OF THE PREFERRED EMBODIMENTS

As mentioned above, the thermosensitive recording material according to the present invention comprises a support material and a thermosensitive color-forming layer formed on the support material, which thermosensitive color-forming layer comprises at least one of the above-mentioned leuco dyes having the formulas (I) and (II) and the other conventional leuco dyes and the zinc thiocyanate antipyrine complex which serves as a color developer capable of inducing color formation in the leuco dye upon application of heat thereto.

To the thermosensitive color-forming layer, the phenolic materials having the previously formulas (III), (IV) and (V) can be used in combination with the zinc thiocyanate antipyrine complex for improvement of the thermal response of the recording material and the stability of the recorded images.

Furthermore, the diester compounds having the previously mentioned formula (VI) and (VII) can also be used in combination with the zinc thiocyanate antipyrine complex for improvement of the image density with highly white background, the thermal response of the recording material and the resistance of the recorded images to water, oils, plasticizers and other chemicals.

The above phenolic materials and the diester compounds serve as auxiliary sensitizer agents to be used with the zinc thiocyanate antipyrine complex. In view of the preservability and thermo-sensitivity of the thermosensitive recording material, it is preferable that the diester compounds have a melting point ranging from 40° C. to 150° C., more preferably a melting point ranging from 50° C. to 120° C.

Of the two types of the fluoran compounds having the general formulas (I) and (II) for use in the present invention, when the fluoran compounds having the general formula (I) and the fluoran compounds having the following formula (IIa) are used, the thermosensitive recording material is so resistant to alcohol that the background thereof is not substantially colored when it comes into contact with alcohol:

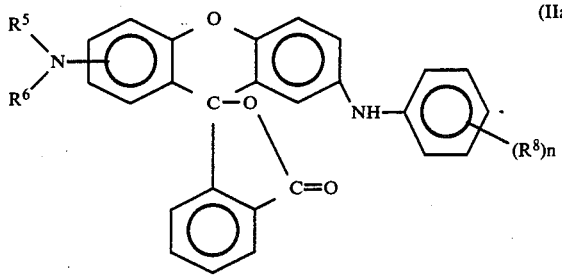

(IIa)

The above formula corresponds to the formula (II) in which $R^6$ each represent an alkyl group having 1 to 6 carbon atoms, $R^7$ represents H, $R^8$ represents an alkyl group having 1 to 2 carbon atoms, or halogen, and represents an integer of 0, 1 or 2.

Specific examples of the fluoran compounds having the following formula (I)

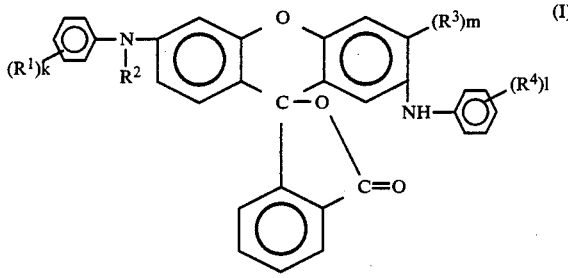

(I)

(wherein $R^1$ and $R^2$ each represent an alkyl group having 1 to 6 carbon atoms, $R^3$ and $R^4$ each represent an alkyl group having 1 to 2 carbon atoms, or halogen, k and l each represent an integer of 0, 1 or 2, and m represents an integer of 0 or 1) are as follows:

3-(N-ethyl-p-toluidino)-6-methyl-7-anilinofluoran,
3-(N-methyl-N-Phenyl))-6-ethyl-7-(p-methylanilino)-fluoran,
3-(N-n-hexyl-p-toluidino)-6-chloro-7-anilinofluoran,
3-(N-ethyl-N-phenyl)-6-methyl-7-(p-chloroanilino)fluoran,
3-(N-n-butyl-N-o,p-dimethylphenyl)-6-methyl-7-anilinofluoran,
3-(N-p-tolyl-N-ethylamino)-6-methyl-7-anilinofluoran,
3-(N-methyl-p-toluidino)-7-(o-chloroanilino)fluoran.

Specific examples of the fluoran compounds having the following formula (II)

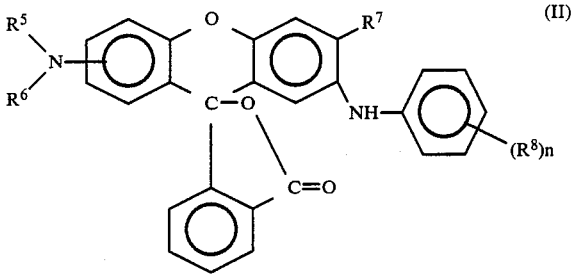

(II)

(wherein $R^5$ and $R^6$ each represent an alkyl group having 1 to 8 carbon atoms, a cyclic hydrocarbon group having 1 to 8 carbon atoms, said alkyl group and said cyclic hydrocarbon groups can contain 1 to 3 ether bondings therein, $R^7$ represents hydrogen, an alkyl group having 1 to 2 carbon atoms, or halogen, $R^8$ represents hydrogen, an alkyl group having 1 to 6 carbon atoms, or halogen, and n represents an integer of 0,1 to 5) are as follows:

3-diethylamino-6-chloro-7-anilinofluoran,
3-diethylamino-6-methyl-7-(o,p-dimethylanilino)fluoran,
3-(N-cyclohexyl-N-methylamino)-6-methyl-7-anilinofluoran,
3-diethylamino-7-(o-chloroanilino)fluoran,
3-(di-n-butylamino)-7-(o-chloroanilino)fluoran,
3-(N-isoamyl-N-ethylamino)-6-methyl-7-anilinofluoran,
3-(N-isoamyl-N-ethylamino)-7-(o,p-dichloroanilino)fluoran,
3-(N-cyclohexyl-N-methylamino)-7-(o-chloranilino)fluoran,
3-diethylamino-7-(o-methylanilino)fluoran,
3-(N-methyl-N-amylamino)-6-methyl-7-anilinofluoran,
3-diethylamino-6-methyl-7-anilinofluoran,
3-(N-methyl-N-n-hexylamino)-6-methyl-7-anilinofluoran,
3-(di-n-butylamino)-6-ethyl-7-anilinofluoran,
3-diethylamino-6-ethyl-7-(4'-methylanilino)fluoran,
3-(N-ethyl-N-isoamylamino)-6-chloro-7-anilinofluoran,
3-di-n-butylamino-6-ethyl-7-p-chloroanilinofluoran,
3-(N-ethyl-N-furfurylamino)-6-methyl-7-anilinofluoran,
3-(N-ethyl-N-tetra-hydrofurfurylamino)-6-methyl-7-anilinofluoran,
3-(N-decyl-N-methylamino)-6-ethyl-7-p-chloroanilinofluoran,
3-(N-2-ethoxyethyl-N-ethyl)-6-methyl-7-anilinofluoran,
3-(N-3-ethoxypropyl-N-ethyl)-6-methyl-7-anilinofluoran.

Other conventional leuco dyes that can be employed in the present invention are triphenylmethane-type leuco compounds, fluoran-type leuco compounds, phenothiazine-type leuco compounds, auramine-type leuco compounds and spiropyran-type leuco compounds.

Specific examples of those leuco dyes are as follows:

3,3-bis(p-dimethylaminophenyl)-phthalide,
3,3-bis(p-dimethylaminophenyl)-6-dimethylaminophthalide (or Crystal Violet Lactone),
Malachite Green Lactone,
3,3-bis(p-dimethylaminophenyl)-6-diethylaminophthalide,
3,3-bis(p-dimethylaminophenyl)-6-chlorophthalide,
3,3-bis(p-dibutylaminophenyl)-phthalide,
3-cyclohexylamino-6-chlorofluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylamino-6-methyl-7-chlorofluoran,
3-pyrrolidino-6-methyl-7-anilinofluoran,
2-[N-(3'-trifluoromethylphenyl)amino]-6-diethylaminofluoran,
2-[3,6-bis (diethylamino)-9-(o-chloroanilino)xanthylbenzoic acid lactam],
3-diethylamino-6-methyl-7-chlorofluoran,
3-diethylamino-6-methyl-7-(m-trichloromethylanilino)fluoran,
3-diethylamino-5-methyl-7-(N,N-dibenzylamino)fluoran,
benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminphenyl)-3-(2'-hydroxy-4'-chloro-5'-methylphenyl)phthalide,
3-morpholino-7-(N-propyl-trifluoromethylanilino)fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-cylorophenyl)methylaminofluoran,
3-diethylamino-5-chloro-7-(α-phenylethylamino)fluoran,
3-(N-ethyl-p-toluidino)-7-(α-phenylethylamino)fluoran,
3-diethylamino-7-(o-methyoxycarbonylphenylamino)fluoran,
3-diethylamino-5-methyl-7-(α-phenylethylamino)fluoran,
3-diethylamino-7-piperdinofluoran,
2-chloro-3-(N-methyltoluidino)-7-(p-n-butylanilino)fluoran,
3-(N-benzyl-N-cyclohexylamino)-5,6-benzo-7-α-naphthylamino-4' -bromofluoran, and
3-diethylamino-6-methyl-7-mesidino-4',5'-benzofluoran.

The above listed leuco dyes can be used alone or in combination.

It is preferable that the zinc thiocyanate antipyrine complex be employed in an amount of 1 to 6 times the amount of the above leuco dye.

Specific examples of the phenolic materials having the following formula (III)

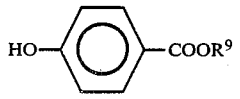

(III)

(wherein $R^9$ represents an alkyl group having 1 to 7 carbon atoms, an unsubstituted or substituted phenyl group, or an unsubstituted or substituted benzyl group) are as follows:

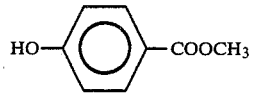

III-1

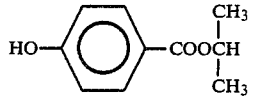

III-2

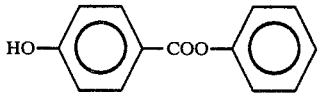

III-3

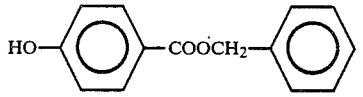

III-4

-continued

III-5

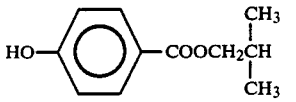

III-6

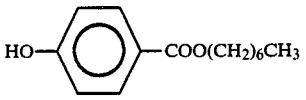

III-7

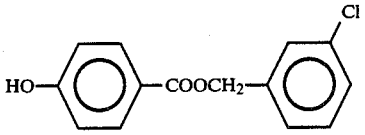

III-8

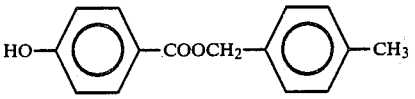

Specific examples of the phenolic materials having the following formula (IV)

(IV)

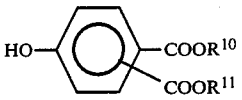

(wherein $R^{10}$ and $R^{11}$ each represent an alkyl group having 1 to 7 carbon atoms, an unsubstituted or substituted phenyl group, or an unsubstituted or substituted benzyl group and $R^{10}$ and $R^{11}$ can be the same or different) are as follows:

IV-1

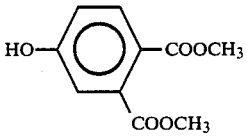

IV-2

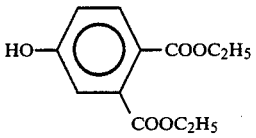

IV-3

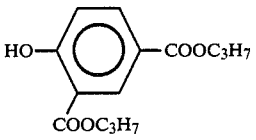

IV-4

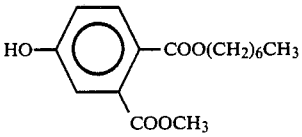

IV-5

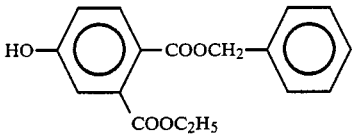

-continued

IV-6

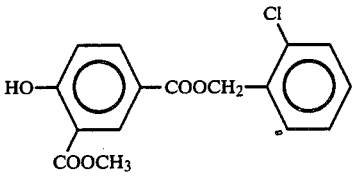

IV-7

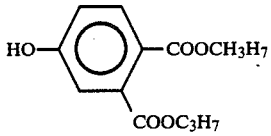

IV-8

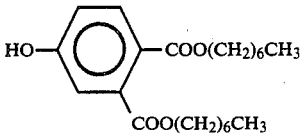

Specific examples of the phenolic materials having the formula (V)

(V)

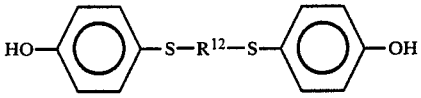

(wherein $R^{12}$ represents an alkylene group having 2 to 10 carbon atoms, the alkylene group containing 1 to 3 ether bonds) are as follows:

V-1

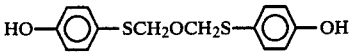

V-2

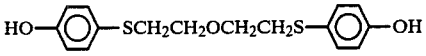

V-3

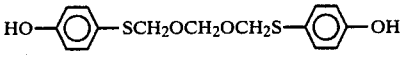

V-4

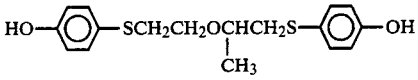

V-5

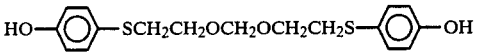

V-6

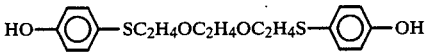

V-7

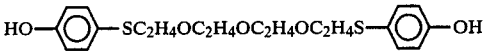

V-8

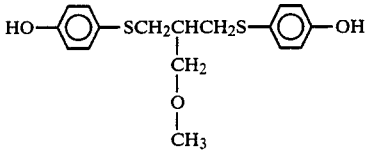

It is preferable that the above phenolic materials having the formula (III), (IV) or (V) be employed in an amount of ⅓ to 10 times, more preferably 1 to 5 times, the amount of the zinc thiocyanate antipyrine complex.

When the above phenolic materials are mixed with the zinc thiocyanate antipyrine complex to prepare a color developer, it is preferable that that color developer be employed in an amount of 1 to 6 times the amount of the leuco dye.

Specific examples of the diester compounds having the following formula (VI)

(VI)

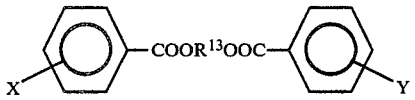

(wherein $R^{13}$ represents an alkylene group, a cycloalkylene group, a substituted or unsubstituted arylene group, or —$R^{16}$—Ar—$R^{17}$—, in which $R^{16}$ and $R^{17}$ each represent a lower alkyl group and Ar represents an unsubstituted or substituted arylene group, X and Y each represent hydrogen, a lower alkyl group, halogen or an alkoxy group, and X and Y can be the same or different) are as follows:

VI-1

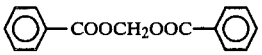

VI-2

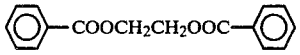

VI-3

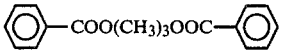

VI-4

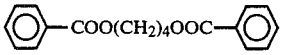

VI-5

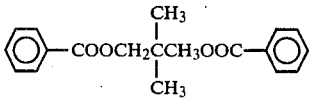

VI-6

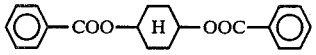

VI-7

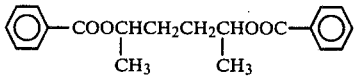

VI-8

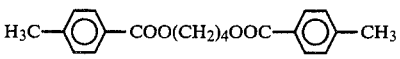

VI-9

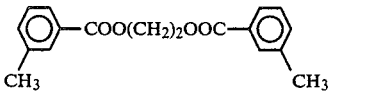

VI-10

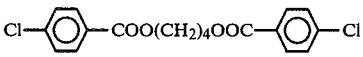

VI-11

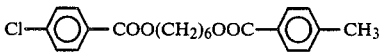

VI-12

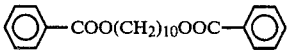

-continued

VI-13

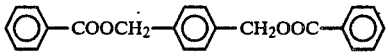

VI-14

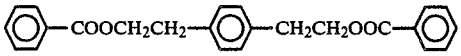

VI-15

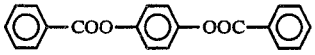

VI-16

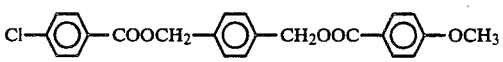

VI-17

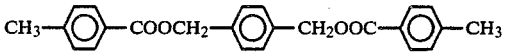

Specific examples of the diesters having the following formula (VII)

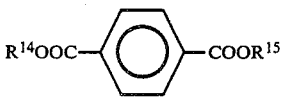

(wherein $R^{14}$ and $R^{15}$ each represent an alkyl group, a cycloalkyl group, a substituted or unsubstituted aryl or aralkyl group, and $R^{14}$ and $R^{15}$ can be the same or different) are as follows:

VII-1

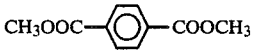

VII-2

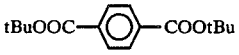

VII-3

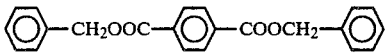

VII-4

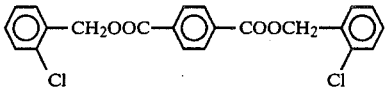

VII-5

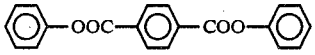

VII-6

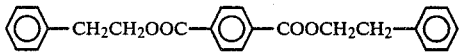

VII-7

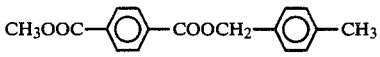

VII-8

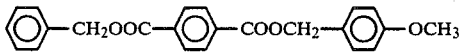

VII-9

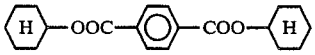

When the above diester compounds having the formula (VI) and (VII) are employed, it is preferable that the leuco dye, the color developer and the diester compound be respectively employed in the amounts of 5 to 40 wt. %, 20 to 60 wt %. and 20 to 60 wt. %.

In the thermosensitive coloring layer of a thermosensitive recording material according to the present invention, the following binder agents can be employed: water-soluble organic polymers such as polyvinyl alcohol, methoxy cellulose, hydroxyethyl cellulose, carboxymethyl cellulose, polyvinyl pyrrolidone, polyacrylamide, polyacrylic acid, starch and gelatin; and water emulsions of polystyrene, copolymer of vinyl chloride and vinyl acetate, and polybutyl methacrylate.

Furthermore, in the thermosensitive coloring layer, the following additives can be contained in the form of fine powder to obtain clear images: calcium carbonate, silica, barium sulfate and aluminum stearate.

In order to increase the thermal sensitivity of the recording material, a variety of conventional thermofusible materials can also be employed. As the thermofusible materials, organic low-molecular-weight compounds, oligomers and polymers having appropriate melting or softening points can be employed. Specific examples of such organic materials are animal waxes, vegetable waxes, mineral waxes, petroleum waxes and other synthesized waxes such as higher fatty acids, higher fatty amine, higher fatty acid amides, phenyl benzoate derivatives, crystalline alkylnaphthalenes, crystalline alkyldiphenyl derivatives and alkylphenyl derivatives.

The thermosensitive recording material according to the present invention can be prepared with a variety of structures, including all the conventional structures in which the coloring reaction between a leuco dye and a color developer is employed. For instance, in the thermosensitive recording material according to the present invention, a leuco dye and the color developer can be supported on the same support material or they can be supported separately on two different support materials.

In the case where a leuco dye and a color developer are supported on the same support material, a thermosensitive coloring layer comprising the leuco dye and the color developer is formed on the support material, with addition of a binder agent thereto, or a thermosensitive coloring layer comprising two layers, with the leuco dye contained in one layer, and the color developer contained in the other layer.

In the case where a leuco dye and the color developer are separately supported on the support materials, those support materials are superimposed on each other in such a manner that the surface of one support material which bears the leuco dye and the surface of the other support material which bears the color developer come into contact with each other when thermal printing is performed. Thereafter, the two support materials are separated, whereby color images are obtained in one support material. In other words, the present invention can be applied to any conventional thermosensitive recording materials which utilize the coloring reaction between a leuco dye and a color developer.

The thermosensitive recording according to the present invention can also be used as a thermal-image-transfer-type thermosensitive recording material which comprises an image transfer sheet consisting of a support material and an image transfer layer formed on the support material, containing a leuco dye, and an image acceptor sheet consisting of a support material and an image acceptor layer formed on the support material, containing the color developer.

In the case of the thermal-image-transfer-type recording material, the image transfer sheet is superimposed on the image acceptor sheet in such a manner that the image acceptor layer comes into contact with the image transfer layer of the image transfer sheet, so that thermal printing is performed on the front side or back side of the superimposed sheets, whereby the desired developed images are formed on the image acceptor layer of the acceptor sheet.

The thermosensitive recording material according to the present invention can be prepared, for example, by application of a thermosensitive coloring layer formation liquid containing the above described components to a support material, for example, paper, synthetic paper or a plastic film, and by drying the same. When the leuco dye and the color developer are supported on two separate support materials, a leuco dye dispersion or solution and a color developer dispersion or solution are applied to each support material.

SYNTHESIS EXAMPLE

Zinc thiocyanate antipyrine complex for use in the present invention was prepared as follows:

14.4 g of zinc sulfate ($ZnSO_4.7H_2O$) and 29.2 g of potassium thiocyanate were dissolved in 200 ml of water to prepare an aqueous solution of potassium thiocyanate.

Apart from the above solution, 18.8 g of antipyrine was dissolved in 200 ml of water to prepare an aqueous solution of antipyrine.

To the aqueous solution of potassium thiocyanate, the aqueous antipyrine solution was added dropwise with stirring. Upon addition of the aqueous antipyrine solution to the potassium thiocyanate solution, a white precipitate was formed in the mixture. This precipitate was filtered off, washed with water and dried, so that white powder was obtained. The white powder was then recrystallized from a mixed solvent of water and ethanol. As a result, 24.2 g of zinc thiocyante antipyrine complex was obtained in the form of white crystals having a melting point of 118° C. to 120° C.

Embodiments of the thermosensitive recording material according to the present invention will now be explained by referring to the following examples.

EXAMPLE 1

A dispersion A-1, a dispersion B-1 and a dispersion C-1 were separately prepared by grinding and dispersing the following respective components in a ceramic ball mill for 2 days:

| | Parts by Weight |
|---|---|
| Dispersion A-1 | |
| 3-(N—ethyl-p-toluidino)-6-methyl-7-anilinofluoran | 20 |
| 10% aqueous solution of hydroxyethyl cellulose | 20 |
| Water | 60 |
| Dispersion B-1 | |
| Zinc thiocyanate antipyrine complex | 20 |
| 5% aqueous solution of methyl cellulose | 20 |
| Water | 60 |
| Dispersion C-1 | |
| Urea-formaldehyde condensation resin powder | 20 |
| 5% aqueous solution of methyl cellulose | 20 |
| Water | 60 |

10 parts by weight of the dispersion A-1, 30 parts by weight of the dispersion B-1, 30 parts by weight of the dispersion C-1 and 10 parts by weight of a 20% aqueous alkali solution of isobutylene-maleic anhydride were mixed to prepare a thermosensitive coloring layer formation liquid.

The thus prepared thermosensitive coloring layer formation liquid was applied to the surface of a sheet of commercially available high quality paper (50 g/m$^2$) by a wire bar and was then dried, whereby a thermosensitive coloring layer was formed thereon. The deposition of the thermosensitive coloring layer on the sheet was in the range of 4 to 5 g/m$^2$ when dried. The thus prepared thermosensitive recording material was subjected to calendering, so that surface of the thermosensitive coloring layer was made smooth to the degree ranging from 500 to 600 sec in terms of Bekk's smoothness, whereby a thermosensitive recording material No. 1 according to the present invention was prepared.

EXAMPLE 2

Example 1 was repeated except that the dispersion A-1 employed in Example 1 was replaced by a dispersion A-2 with the following formulation, whereby a thermosensitive recording material No. 2 according to the present invention was prepared.

| Dispersion A-2 | Parts by Weight |
|---|---|
| 3-di-n-butylamino-7-(o-chloroanilino) fluoran | 20 |
| 10% aqueous solution of hydroxyethyl cellulose | 20 |
| Water | 60 |

EXAMPLE 3

Example 1 was repeated except that the dispersion A-1 employed in Example 1 was replaced by a dispersion A-3 with the following formulation, whereby a thermosensitive recording material No. 3 according to the present invention was prepared.

| Dispersion A-3 | Parts by Weight |
|---|---|
| 3-diethylamino-7-(o-chloroanilino) fluoran | 20 |
| 10% aqueous solution of hydroxyethyl cellulose | 20 |
| Water | 60 |

EXAMPLE 4

Example 1 was repeated except that the dispersion A-1 employed in Example 1 was replaced by a dispersion A-4 with the following formulation, whereby a thermosensitive recording material No. 4 according to the present invention was prepared.

| Dispersion A-4 | Parts by Weight |
|---|---|
| 3-(N—cyclohexyl-N—methylamino)-6-methyl-7-anilinofluoran | 20 |
| 10% aqueous solution of hydroxyethyl cellulose | 20 |
| Water | 60 |

EXAMPLE 5

Example 1 was repeated except that the dispersion A-1 employed in Example 1 was replaced by a dispersion A-5 with the following formulation, whereby a thermosensitive recording material No. 5 according to the present invention was prepared.

| Dispersion A-5 | Parts by Weight |
|---|---|
| 3-diethylamino-6-methyl-7-anilino-fluoran | 20 |
| 10% aqueous solution of hydroxyethyl cellulose | 20 |
| Water | 60 |

EXAMPLE 6

Example 1 was repeated except that the dispersion A-1 employed in Example 1 was replaced by a dispersion A-6 with the following formulation, whereby a thermosensitive recording material No. 6 according to the present invention was prepared.

| Dispersion A-6 | Parts by Weight |
|---|---|
| 3-(N—isoamyl-N—ethylamino)-6-methyl-7-anilinofluoran | 20 |
| 10% aqueous solution of hydroxyethyl cellulose | 20 |
| Water | 60 |

COMPARATIVE EXAMPLE 1

Example 1 was repeated except that the dispersion A-1 employed in Example 1 was replaced by a comparative dispersion CA-1 with the following formulation, whereby a comparative thermosensitive recording material No. 1 was prepared.

| Comparative Dispersion CA-7 | Parts by Weight |
|---|---|
| 3-diethylamino)-7-(m-trifluorometyl-anilino)fluoran | 20 |
| 10% aqueous solution of hydroxyethyl cellulose | 20 |
| Water | 60 |

COMPARATIVE EXAMPLE 2

The dispersion A-2 employed in Example 2, a comparative dispersion CB-1 having the following formulation and the dispersion C-1 employed in Example 1 were separately prepared by grinding and dispersing the respective components in a ceramic ball mill for 2 days:

| Comparative Dispersion CB-1 | Parts by Weight |
|---|---|
| Zinc thiocyanate imidazole complex (m.p. 143 to 145° C.) | 20 |
| 5% aqueous solution of methyl cellulose | 20 |
| Water | 60 |

10 parts by weight of the dispersion A-2, 30 parts by weight of the comparative dispersion CB-1, 30 parts by weight of the dispersion C-1 and 10 parts by weight of a 20% aqueous alkali solution of isobutylene - maleic anhydride were mixed to prepare a thermosensitive coloring layer formation liquid.

By use of this thermosensitive coloring layer formation liquid, a comparative thermosensitive recording material No. 2 was prepared in the same manner as in Example 1.

COMPARATIVE EXAMPLE 3

The dispersion A-2 employed in Example 2, a comparative dispersion CB-2 having the following formulation and the dispersion C-1 employed in Example 1 were separately prepared by grinding and dispersing the respective components in a ceramic ball mill for 2 days:

| Comparative Dispersion CB-2 | Parts by Weight |
|---|---|
| Bisphenol A | 20 |
| 5% aqueous solution of methyl cellulose | 20 |
| Water | 60 |

10 parts by weight of the dispersion A-2, 30 parts by weight of the comparative dispersion CB-2, 30 parts by weight of the dispersion C-1 and 10 parts by weight of a 20% aqueous alkali solution of isobutylene - maleic anhydride were mixed to prepare a comparative thermosensitive coloring layer formation liquid.

By use of this comparative thermosensitive coloring layer formation liquid, a comparative thermosensitive recording material No. 3 was prepared in the same manner as in Example 1.

COMPARATIVE EXAMPLE 4

Example 4 was repeated except that the dispersion B-1 employed in Example 4 was replaced by the comparative dispersion CB-1 employed in Comparative Example 2, whereby a comparative thermosensitive recording material No. 4 was prepared.

COMPARATIVE EXAMPLE 5

Example 4 was repeated except that the dispersion B-1 employed in Example 4 was replaced by the comparative dispersion CB-2 employed in Comparative Example 3, whereby a comparative thermosensitive recording material No. 5 was prepared.

The thermosensitive recording materials No. 1 through No. 6 according to the present invention and the comparative thermal recording materials No. 1 through No. 5 were subjected to thermal printing tests by use of a heat gradient test apparatus (made by Toyo Seiki Co., Ltd.) at 150° C. with a pressure of 2 kg/cm$^2$, with a heat application time of 1 second, so that printed images were formed on each of the thermosensitive recording materials.

To the printed images on the thermosensitive recording materials, there was applied cotton seed oil, and the recording materials were then allowed to stand for 24 hours to see whether or not the images were discolored or caused to disappear by the oil.

As a result, the images recorded on the thermosensitive recording materials No. 1 through No. 6 according to the present invention and the comparative thermosensitive recording material No. 1 did not fade away at all and the backgrounds thereof were not colored. The images recorded on the comparative thermosensitive recording materials No. 2 and No. 4 did not fade away, but the backgrounds thereof were colored. The backgrounds of the comparative thermosensitive recording materials No. 3 and No. 5 were not colored, but the recorded images thereof almost completely faded away.

Samples of the above thermosensitive recording materials with a size of 4 cm$^2$ were made so as to include image areas in the central portion thereof and were laid on a polyvinyl chloride film (Poly Wrapper V-300 made by The Shin-Etsu Chemical Industry Co., Ltd.) with a load of 500g/cm$^2$ applied at room temperature for 24 hours. Thereafter, the densities of the image areas of those samples was measured by a Macbeth densitometer RD-514, so that the image densities of the samples before the above polyvinyl chloride film test and after the test were compared (hereinafter referred to as the polyvinyl chloride film test). The results were as shown in the following Table 1.

TABLE 1

| Thermosensitive Recording Material | I.D (Before) | I.D. (After) | B.D. (Before) | B.D. (After) |
|---|---|---|---|---|
| No. 1 | 1.01 | 1.03 | 0.07 | 0.07 |
| No. 2 | 1.00 | 1.01 | 0.08 | 0.07 |
| No. 3 | 0.98 | 0.99 | 0.08 | 0.08 |
| No. 4 | 1.22 | 1.23 | 0.09 | 0.10 |
| No. 5 | 1.18 | 1.24 | 0.10 | 0.13 |
| No. 6 | 1.14 | 1.21 | 0.10 | 0.11 |
| Comp. No. 1 | 1.03 | 1.06 | 0.08 | 0.88 |
| Comp. No. 2 | 1.25 | 1.23 | 0.28 | 0.61 |
| Comp. No. 3 | 1.30 | 0.17 | 0.07 | 0.07 |
| Comp. No. 4 | 1.30 | 1.32 | 0.27 | 1.08 |
| Comp. No. 5 | 1.27 | 0.35 | 0.11 | 0.10 |

Note:
I.D. (Before) denotes the image density before the test;
I.D. (After), the image density after the test;
B.D. (Before), the background density before the test, and
B.D. (After), the background density after the test.

To each of the thermosensitive the recording materials No. 1 through No. 3, ethanol was slightly applied to see if any change occurs in the background density. The results were as follows:

TABLE 2

| Thermosensitive Recording Material | B.D. (Before) | B.D. (After) |
|---|---|---|
| No. 1 | 0.07 | 0.10 |
| No. 2 | 0.08 | 0.09 |
| No. 3 | 0.08 | 0.10 |
| No. 4 | 0.09 | 0.39 |
| No. 5 | 0.10 | 0.52 |
| No. 6 | 0.10 | 0.50 |
| Comp. No. 1 | 0.08 | 0.42 |
| Comp. No. 2 | 0.28 | 1.05 |
| Comp. No. 3 | 0.17 | 0.60 |

The above results indicate that the thermosensitive recording materials No. 1 through No. 3 in which the fluoran compounds covered by the previously described general formulas (I) and (IIa) are used are particularly excellent in the resistance to alcohol.

EXAMPLE 7

A dispersion A-7 with the following formulation, the dispersion B-1 employed in Example 1 and the dispersion C-1 empolyed in Example 1 were separately prepared by grinding and dispersing the respective components in a ceramic ball mill for 2 days:

| Dispersion A-7 | Parts by Weight |
|---|---|
| 3-(N—ethyl-N—tetrahydrofurfurylamino)-6-methyl-7-anilinofluoran | 20 |
| 10% aqueous solution of hydroxyethyl cellulose | 20 |
| Water | 60 |

10 parts by weight of the dispersion A-7, 30 parts by weight of the dispersion B-1, 30 parts by weight of the dispersion C-1 and 10 parts by weight of the 20% aqueous alkali solution of isobutylene - maleic anhydride were mixed to prepare a thermosensitive coloring layer formation liquid.

By use of this thermosensitive coloring layer formation liquid, a thermosensitive recording material No. 7 according to the present invention was prepared in the same manner as in Example 1.

EXAMPLE 8

Example 7 was repeated except that the dispersion A-7 employed in Example 7 was replaced by a dispersion A-8 with the following formulation, whereby a thermosensitive recording material No. 8 according to the present invention was prepared.

| Dispersion A-8 | Parts by Weight |
|---|---|
| 3-(N—3-ethoxypropyl-N—ethylamino)-6-methyl-7-anilinofluoran | |
| 10% aqueous solution of hydroxyethyl cellulose | 20 |
| Water | 60 |

EXAMPLE 9

Example 7 was repeated except that the dispersion A-7 employed in Example 7 was replaced by a dispersion A-9 with the following formulation, whereby a thermosensitive recording material No. 9 according to the present invention was prepared.

| Dispersion A-9 | Parts by Weight |
|---|---|
| 3-(N—ethyl-N—p-tolylamino)-6-methyl-7-anilinofluoran | 20 |
| 10% aqueous solution of hydroxyethyl cellulose | 20 |
| Water | 60 |

EXAMPLE 10

Example 7 was repeated except that the dispersion A-7 employed in Example 7 was replaced by a dispersion A-10 with the following formulation, whereby a thermosensitive recording material No. 10 according to the present invention was prepared.

| Dispersion A-10 | Parts by Weight |
|---|---|
| 3-di-n-butylamino-7-(o-chloroanilino) fluoran | 20 |
| 10% aqueous solution of hydroxyethyl cellulose | 20 |
| Water | 60 |

COMPARATIVE EXAMPLE 6

Example 7 was repeated except that the dispersion B-1 employed in Example 7 was replaced by the comparative dispersion CB-1 having the following formulation, which was employed in Comparative Example 2, whereby a comparative thermosensitive recording material No. 6 was prepared.

| Comparative Dispersion CB-1 | Parts by Weight |
|---|---|
| Zinc thiocyanate imidazole complex (m.p. 143 to 145° C.) | 20 |

-continued

| Comparative Dispersion CB-1 | Parts by Weight |
|---|---|
| 5% aqueous solution of methyl cellulose | 20 |
| Water | 60 |

COMPARATIVE EXAMPLE 7

Example 7 was repeated except that the dispersion B-1 which was employed in Example 7 was replaced by the comparative dispersion CB-2 having the following formulation, which was employed in Comparative Example 3, whereby a comparative thermosensitive recording material No. 7 was prepared.

| Comparative Dispersion B-2 | Parts by Weight |
|---|---|
| Bisphenol A | 20 |
| 5% aqueous solution of methyl cellulose | 20 |
| Water | 60 |

The thermosensitive recording materials No. 7 through No. 10 according to the present invention and the comparative thermal recording materials No. 6 and No. 7 were subjected to the same thermal printing test as that carried out in Example 1, so that printed images were formed on each of the thermosensitive recording materials.

To the printed images on the thermosensitive recording materials, there was applied cotton seed oil, and the recording materials were then allowed to stand for 24 hours to see whether or not the images were discolored or caused to disappear by the oil.

As a result, the images recorded on the thermosensitive recording material No. 7 through No. 10 according to the present invention did not fade away at all and the backgrounds thereof were not colored. The images recorded on the comparative thermosensitive recording material No. 6 did not fade away, but the background thereof was colored. The background of the comparative thermosensitive recording material No. 7 was not colored, but the recorded images faded away.

Samples of the above thermosensitive recording materials with a size of 4 $cm^2$ were made so as to include image areas in the central portion thereof and were subjected to the same polyvinyl chloride film test as previously described. The results were as shown in the following Table 3.

TABLE 3

| Thermosensitive Recording Material | I.D. (Before) | I.D. (After) | B.D. (Before) | B.D. (After) |
|---|---|---|---|---|
| No. 7 | 1.23 | 1.23 | 0.09 | 0.10 |
| No. 8 | 1.21 | 1.20 | 0.08 | 0.09 |
| No. 9 | 1.01 | 1.03 | 0.07 | 0.07 |
| No. 10 | 1.00 | 1.01 | 0.08 | 0 07 |
| Comp. No. 6 | 1.32 | 1.35 | 0.37 | 1.05 |
| Comp. No. 7 | 1.31 | 1.18 | 0.08 | 0.08 |

Samples of the above thermosensitive recording materials with a size of 4 $cm^2$ were made so as to include image areas in the central portion theeof. Those samples were immersed in city water in a 100 ml flask and were remained there at room temperature for 24 hours. The samples were taken out from the flask and were then dried. Thereafter, the densities of the image areas of those samples were measured by a Macbeth densitometer RD-514, so that the image densities of the samples before the immersion into water and those after the immersion were compared. The results were as shown in the following Table 4.

TABLE 4

| Thermosensitive Recording Material | Image Density before Immersion | Image Density after Immersion |
|---|---|---|
| No. 7 | 1.23 | 1.08 |
| No. 8 | 1.21 | 1.05 |
| No. 9 | 1.01 | 0.55 |
| No. 10 | 1.00 | 0.57 |
| Comp. No. 6 | 1.32 | 1.28 |
| Comp. No. 7 | 1.31 | 1.08 |

EXAMPLE 11

A dispersion A-11 with the following formulation, the dispersion B-1 and the dispersion C-1 which were employed in Example 1 were separately prepared by grinding and dispersing the respective components in a ceramic ball mill for 2 days:

| Dispersion A-11 | Parts by Weight |
|---|---|
| 3-diethylamino-7-anilinofluoran | 20 |
| 10% aqueous solution of hydroxyethyl cellulose | 20 |
| Water | 60 |

10 parts by weight of the dispersion A-11, 30 parts by weight of the dispersion B-1, 30 parts by weight of the dispersion C-1 and 10 parts by weight of the 20% aqueous alkali solution of isobutylene-maleic anhydride were mixed to prepare a thremosensitive coloring layer formation liquid.

By use of this thermosensitive coloring layer formation liquid, a thermosensitive recording material No. 11 according to the present invention was prepared in the same manner as in Example 1.

EXAMPLE 12

Example 11 was repeated except that the dispersion A-11 employed in Example 11 was replaced by a dispersion A-12 with the following formulation, whereby a thermosensitive recording material No. 12 according to the present invention was prepared.

| Dispersion A-12 | Parts by Weight |
|---|---|
| 3-(N—isoamyl-N—ethylamino)-7-anilino-fluoran | 20 |
| 10% aqueous solution of hydroxyethyl cellulose | 20 |
| Water | 60 |

COMPARATIVE EXAMPLE 8

Example 11 was repeated except that the dispersion B-1 employed in Example 11 was replaced by the comparative dispersion CB-1 having the following formulation, whereby a comparative thermosensitive recording material No. 8 was prepared.

| Comparative Dispersion CB-1 | Parts by Weight |
|---|---|
| Zinc thiocyanate imidazole complex (m.p. 143 to 145° C.) | 20 |

-continued

| Comparative Dispersion CB-1 | Parts by Weight |
|---|---|
| 5% aqueous solution of methyl cellulose | 20 |
| Water | 60 |

COMPARATIVE EXAMPLE 9

Example 11 was repeated except that the dispersion B-1 employed in Example 11 was replaced by the comparative dispersion CB-2 having the following formulation, whereby a comparative thermosensitive recording material No. 9 was prepared.

| Comparative Dispersion CB-2 | Parts by Weight |
|---|---|
| Bisphenol A | 20 |
| 5% aqueous solution of methyl cellulose | 20 |
| Water | 60 |

The thermosensitive recording materials No. 11 and No. 12 according to the present invention and the comparative thermal recording materials No. 8 and No. 9 were subjected to the previously described thermal printing tests, so that printed images were formed on each of the thermosensitive recording materials.

To the printed images on the thermosensitive recording materials, there was applied cotton seed oil, and the recording materials were then allowed to stand for 24 hours to see whether or not the images were discolored or caused to disappear by the oil.

As a result, the images recorded on the thermosensitive recording materials No. 11 and No. 12 according to the present invention did not fade away at all and the backgrounds thereof were not colored. The images recorded on the comparative thermosensitive recording material No. 8 did not fade away, but the background thereof was colored. The background of the comparative thermosensitive recording material No. 9 was not colored, but the recorded images faded away.

Samples of the above thermosensitive recording materials with a size of 4 $cm^2$ were made so as to include image areas in the central portion thereof and were subjected to the polyvinyl chloride film test. The results were as shown in the following Table 5.

TABLE 5

| Thermosensitive Recording Material | I.D. (Before) | I.D. (After) | B.D. (Before) | B.D. (After) |
|---|---|---|---|---|
| No. 11 | 1.18 | 1.24 | 0.10 | 0.13 |
| No. 12 | 1.14 | 1.21 | 0.10 | 0.11 |
| Comp. No. 8 | 1.32 | 1.35 | 0.37 | 1.05 |
| Comp. No. 9 | 1.31 | 1.18 | 0.08 | 0.08 |

Samples of the above thermosensitive recording materials with a size of 4 $cm^2$ were made so as to include image areas in the central portion thereof. Those samples were immeresed in city water in a 100 ml flask and were remained there at room temperature for 24 hours. The samples were taken out from the flask and were then dried. Thereafter, the densities of the image areas of those samples were measured by a Macbeth densitometer RD-514, so that the image densities of the samples before the immersion into water and those after the immersion were compared. The results were as shown in the following Table 6.

TABLE 6

| Thermosensitive Recording Material | Image Density before Immersion | Image Density after Immersion |
|---|---|---|
| No. 11 | 1.18 | 1.03 |
| No. 12 | 1.14 | 1.01 |
| Comp. No. 8 | 1.32 | 1.28 |
| Comp. No. 9 | 1.31 | 1.08 |

EXAMPLE 13

The dispersion A-4 with the following formulation, which was employed in Example 4, the dispersion B-1, the dispersion C-1 and a dispersion D-1 with the following formulation were separately prepared by grinding and dispersing the respective components in a ceramic ball mill for 2 days:

| | Parts by Weight |
|---|---|
| Dispersion A-4 | |
| 3-(N—cyclohexyl-N—methylamino)-6-methyl-7-anilinofluoran | 20 |
| 10% aqueous solution of hydroxyethyl cellulose | 20 |
| Water | 60 |
| Dispersion D-1 | |
| p-hydroxybenzoic acid benzyl ester | 20 |
| 10% aqueous solution of hydroxyethyl cellulose | 20 |
| Water | 60 |

10 parts by weight of the dispersion A-4, 30 parts by weight of the dispersion B-1, 30 parts by weight of the dispersion C-1, 30 parts by weight of the dispersion D-1 and 10 parts by weight of a 20% aqueous alkali solution of isobutylene-maleic anhydride were mixed to prepare a thermosensitive coloring layer formation liquid.

By use of this thermosensitive coloring layer formation liquid, a thermosensitive recording material No. 13 according to the present invention was prepared in the same manner as in Example 1.

EXAMPLE 14

Example 13 was repeated except that the dispersion D-1 employed in Example 13 was replaced by a dispersion D-2 with the following formulation, whereby a thermosensitive recording material No. 14 according to the present invention was prepared.

| Dispersion D-2 | Parts by Weight |
|---|---|
| 4-hyrdroxyphthalic acid dimethyl ester | 20 |
| 10% aqueous solution of hydroxyethyl cellulose | 20 |
| Water | 60 |

EXAMPLE 15

Example 13 was repeated except that the dispersion D-1 employed in Example 13 was replaced by a dispersion D-3 with the following formulation, whereby a thermosensitive recording material No. 15 according to the present invention was prepared.

| Dispersion D-3 | Parts by Weight |
|---|---|
| 1,7-di(4-hydroxyphenylthio)-3,5-dioxaheptane | 20 |
| 10% aqueous solution of hydroxyethyl cellulose | 20 |
| Water | 60 |

EXAMPLE 16

Example 13 was repeated except that the dispersion D-1 employed in Example 13 was not employed, but the dispersion B-1 was increased by the amount corresponding to the amount of the dispersion D-1, whereby a thermosensitive recording material No. 16 according to the present invention was prepared.

COMPARATIVE EXAMPLE 10

Example 13 was repeated except that the dispersion B-1 employed in Example 13 was replaced by the comparative dispersion CB-1 having the following formulation, whereby a comparative thermosensitive recording material No. 10 was prepared.

| Comparative Dispersion CB-1 | Parts by Weight |
|---|---|
| Zinc thiocyanate imidazole complex (m.p. 143 to 145° C.) | 20 |
| 5% aqueous solution of methyl cellulose | 20 |
| Water | 60 |

COMPARATIVE EXAMPLE 11

Example 13 was repeated except that the dispersion B-1 employed in Example 13 was replaced by the comparative dispersion CB-2 having the following formulation, whereby a comparative thermosensitive recording material No. 11 was prepared.

| Comparative Dispersion CB-2 | Parts by Weight |
|---|---|
| Bisphenol A | 20 |
| 5% aqueous solution of methyl cellulose | 20 |
| Water | 60 |

COMPARATIVE EXAMPLE 12

Example 13 was repeated except that the dispersion B-1 employed in Example 13 was not employed, but the dispersion D-1 was increased by the amount corresponding to the amount of the dispersion B-1, whereby a comparative thermosensitive recording material No. 12 was prepared.

COMPARATIVE EXAMPLE 13

Example 14 was repeated except that the dispersion B-1 employed in Example 14 was not employed, but the dispersion D-2 was increased by the amount corresponding to the amount of the dispersion B-1, whereby a comparative thermosensitive recording material No. 13 was prepared.

COMPARATIVE EXAMPLE 14

Example 15 was repeated except that the dispersion B-1 employed in Example 15 was not employed, but the dispersion D-3 was increased by the amount corresponding to the amount of the dispersion B-1, whereby a comparative thermosensitive recording material No. 14 was prepared.

The thermosensitive recording materials No. 13 through No. 16 according to the present invention and the comparative thermosensitive recording materials No. 10 through No. 14 were subjected to the same thermal printing test as in Example 1 so that printed images were formed on each of the thermosensitive recording materials.

To the printed images on the thermosensitive recording materials, there was applied cotton seed oil, and the recording materials were then allowed to stand for 24 hours to see whether or not the images were discolored or caused to disappear by the oil.

As a result, the images recorded on the thermosensitive recording materials No. 13 through No. 16 according to the present invention and the comparative thermosensitive recording material No. 11 did not fade away at all and the backgrounds thereof were not colored. The images recorded on the comparative thermosensitive recording material No. 10 did not fade away, but the background thereof was colored. The backgrounds of the comparative thermosensitive recording materials Nos. 12, 13 and 14 were not colored, but the recorded images completely faded away.

Samples of the above thermosensitive recording materials with a size of 4 $cm^2$ were made so as to include image areas in the central portion thereof and were subjected to the same polyvinyl chloride film test as in Example 1. The results were as shown in the following Table 7.

TABLE 7

| Thermosensitive Recording Material | I.D. (Before) | I.D. (After) | B.D. (Before) | B.D. (After) |
|---|---|---|---|---|
| No. 13 | 1.30 | 1.25 | 0.13 | 0.13 |
| No. 14 | 1.26 | 1.24 | 0.12 | 0.11 |
| No. 15 | 1.30 | 1.25 | 1.10 | 0.10 |
| No. 16 | 1.18 | 1.15 | 0.09 | 0.09 |
| Comp. No. 10 | 1.29 | 1.31 | 0.30 | 1.10 |
| Comp. No. 11 | 1.23 | 1.09 | 0.33 | 0.25 |
| Comp. No. 12 | 1.30 | 0.25 | 0.10 | 0.08 |
| Comp. No. 13 | 1.29 | 0.21 | 0.09 | 0.09 |
| Comp. No. 14 | 1.31 | 0.58 | 0.09 | 0.08 |

The thermosensitive recording materials No. 13 through No. 16 according to the present invention and the comparative thermosensitive recording materials No. 10 through No. 14 were subjected to thermal printing by use of a thermal printing test apparatus including a thermal head (made by Matsushita Electronic Components Co., Ltd.) under the conditions that the power applied to the head was 0.45 W/dot, the recording time per line was 20 msec, the scanning line density was $8\times3.85$ dots/mm, with the pulse width applied thereto changed to 3 steps of 1.6 msec, 2.0 msec, and 2.4 msec. The density of the developed images was measured by Macbeth densitometer RD-514 with a filter W-106. The results are shown in the following Table 8.

TABLE 8

| Thermosensitive Recording Material | Developed Image Density Pulse width (msec) | | |
|---|---|---|---|
| | 1.6 | 2.0 | 2.4 |
| No. 13 | 0.97 | 1.20 | 1.29 |
| No. 14 | 0.95 | 1.19 | 1.28 |
| No. 15 | 0.99 | 1.21 | 1.30 |
| No. 16 | 0.45 | 0.67 | 0.81 |
| Comp. No. 10 | 1.07 | 1.22 | 1.26 |
| Comp. No. 11 | 0.88 | 1.07 | 1.10 |
| Comp. No. 12 | 1.04 | 1.23 | 1.30 |

TABLE 8-continued

| Thermosensitive Recording Material | Developed Image Density Pulse width (msec) | | |
|---|---|---|---|
| | 1.6 | 2.0 | 2.4 |
| Comp. No. 13 | 1.02 | 1.21 | 1.28 |
| Comp. No. 14 | 1.05 | 1.25 | 1.31 |

The above results indicate that the thermosensitive recording materials according to the present invention are excellent in development performance and discoloration by the oil and stabler in quality as compared with the comparative thermosensitive recording material examples.

EXAMPLE 17

The dispersion A-4 with the following formulation, which was employed in Example 4, the dispersion B-1, the dispersion C-1 and a dispersion E-1 with the following formulation were separately prepared by grinding and dispersing the respective components in a ceramic ball mill for 2 days:

| | Parts by Weight |
|---|---|
| Dispersion A-4 | |
| 3-(N—cyclohexyl-N—methylamino)-6-methyl-7-anilinofluoran | 20 |
| 10% aqueous solution of hydroxyethyl cellulose | 20 |
| Water | 60 |
| Dispersion E-1 | |
| Tetramethylene glycol dibenzoate (m.p. 81–82° C.) | 20 |
| 5% aqueous solution of methyl cellulose | 20 |
| Water | 60 |

10 parts by weight of the dispersion A-4, 30 parts by weight of the dispersion B-1, 30 parts by weight of the dispersion C-1, 20 parts by weight of the dispersion E-1 and 10 parts by weight of a 20% aqueous alkali solution of isobutylene-maleic anhydride were mixed to prepare a thermosensitive coloring layer formation liquid.

By use of this thermosensitive coloring layer formation liquid, a thermosensitive recording material No. 17 according to the present invention was prepared in the same manner as in Example 1.

EXAMPLE 18

Example 17 was repeated except that the dispersion E-1 employed in Example 17 was replaced by a dispersion E-2 with the following formulation, whereby a thermosensitive recording material No. 18 according to the present invention was prepared.

| Dispersion E-2 | Parts by Weight |
|---|---|
| p-xyleneglycol dibenzoate (m.p. 86–87° C.) | 20 |
| 10% aqueous solution of methyl cellulose | 20 |
| Water | 60 |

EXAMPLE 19

Example 17 was repeated except that the dispersion E-1 employed in Example 17 was replaced by a dispersion E-3 with the following formulation, whereby a thermosensitive recording material No. 19 according to the present invention was prepared.

| Dispersion E-3 | Parts by Weight |
|---|---|
| Dibenzylterephthalate (m.p. 94–96° C.) | 20 |
| 10% aqueous solution of methyl cellulose | 20 |
| Water | 60 |

EXAMPLE 20

Example 17 was repeated except that water was employed instead of the dispersion E-1, whereby a comparative thermosensitive recording material No. 20 according to the present invention was prepared.

COMPARATIVE EXAMPLE 15

Example 18 was repeated except that the dispersion E-2 employed in Example 18 was replaced by the comparative dispersion CE-1 having the following formulation, whereby a comparative thermosensitive recording material No. 13 was prepared.

| Dispersion E-3 | Parts by Weight |
|---|---|
| Dibenzylterephthalate (m.p. 94–96° C.) | 20 |
| 10% aqueous solution of methyl cellulose | 20 |
| Water | 60 |

The thermosensitive recording materials No. 17 through No. 20 according to the present invention and the comparative thermal recording material No. 13 were subjected to the same thermal printing tests as that carried out in Example 1, so that printed images were formed on each of the thermosensitive recording materials.

To the printed images on the thermosensitive recording materials, there was applied cotton seed oil, and the recording materials were then allowed to stand for 24 hours to see whether or not the images were discolored or caused to disappear by the oil.

As a result, the images recorded on the thermosensitive recording materials No. 17 through No. 20 according to the present invention and the comparative thermosensitive recording material No. 15 did not fade away at all and the backgrounds thereof were not colored.

Samples of the above thermosensitive recording materials with a size of 4 $cm^2$ were made so as to include image areas in the central portion thereof and were subjected to the polyvinyl chloride film test. The results were as shown in the following Table 9.

TABLE 9

| Thermosensitive Recording Material | I.D. (Before) | I.D. (After) | B.D. (Before) | B.D. (After) |
|---|---|---|---|---|
| No. 17 | 1.30 | 1.29 | 0.08 | 0.08 |
| No. 18 | 1.30 | 1.30 | 0.08 | 0.09 |
| No. 19 | 1.29 | 1.28 | 0.08 | 0.09 |
| No. 20 | 1.24 | 1.23 | 0.08 | 0.08 |
| Comp. No. 15 | 1.28 | 1.27 | 0.09 | 0.10 |

The thermosensitive recording materials No. 17 through No. 20 according to the present invention and the comparative thermosensitive recording material No. 15 were subjected to thermal printing by use of a thermal printing test apparatus including a thermal head (made by Matsushita Electronic Components Co., Ltd.) under the conditions that the power applied to the head was 0.45 W/dot, the recording time per line was 20 msec, the scanning line density was 8×3.85 dots/mm, with the pulse width applied thereto changed to 3 steps of 1.6 msec, 2.0 msec, and 2.4 msec. The density of the developed images was measured by Macbeth densitometer RD-514 with a filter W-106. The results are shown in the following Table 10.

TABLE 10

| Thermosensitive Recording Material | Developed Image Density Pulse width (msec) 1.6 | 2.0 | 2.4 | Background Density |
|---|---|---|---|---|
| No. 17 | 0.94 | 1.20 | 1.28 | 0.08 |
| No. 18 | 0.92 | 1.19 | 1.27 | 0.08 |
| No. 19 | 0.90 | 1.17 | 1.25 | 0.08 |
| No. 20 | 0.51 | 0.84 | 0.98 | 0.08 |
| Comp. No. 19 | 0.52 | 0.98 | 1.14 | 0.09 |

Samples of the above thermosensitive recording materials with a size of 4 $cm^2$ were made so as to include image areas in the central portion thereof. Those samples were immersed in city water in a 100 ml flask and were remained there at room temperature for 24 hours. The samples were taken out from the flask and were then dried. Thereafter, the densities of the image areas of those samples were measured by a Macbeth densitometer RD-514, so that the image densities of the samples before the immersion into water and those after the immersion were compared. The results were as shown in the following Table 11.

TABLE 11

| Thermosensitive Recording Material | Image Density before Immersion | after Immersion |
|---|---|---|
| No. 17 | 1.30 | 1.29 |
| No. 18 | 1.30 | 1.29 |
| No. 19 | 1.29 | 1.27 |
| No. 20 | 1.24 | 0.76 |
| Comp. No. 19 | 1.28 | 0.88 |

As can be seen from the above results, the thermosensitive recording materials according to the present invention are excellent in development performance and non-discoloration by the oil and stabler in quality as compared with the comparative thermosensitive recording material example.

What is claimed is:

1. In a thermosensitive recording material comprising a colorless or light-colored coloring material, a color developer capable of inducing color formation in said colorless or light-colored coloring material upon application of heat thereto, and support means for supporting said coloring material and said color developer so that said color formation can be induced, the improvement wherein said coloring material is a leuco dye, and said color developer is a zinc thiocyanate antipyrine complex of the formula

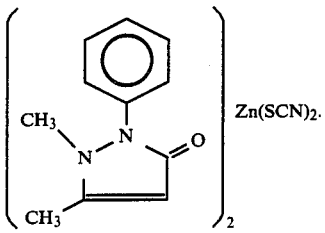

2. A thermosensitive recording material as claimed in claim 1, wherein said leuco dye is selected from the group consisting of:

(1) fluoran compounds having general formula (I),

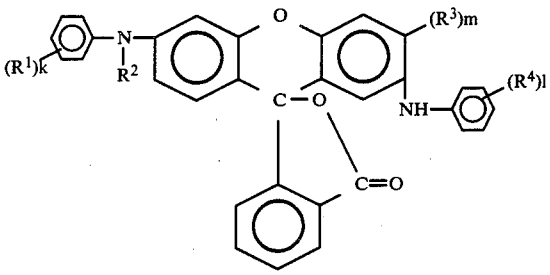

wherein $R^1$ and $R^2$ each represent an alkyl group having 1 to 6 carbon atoms, $R^3$ and $R^4$ each represent an alkyl group having 1 to 2 carbon atoms, or halogen, k and l each represent an integer of 0, 1 or 2, and m represents an integer of 0 or 1; and (2) fluoran compounds having general formula (II),

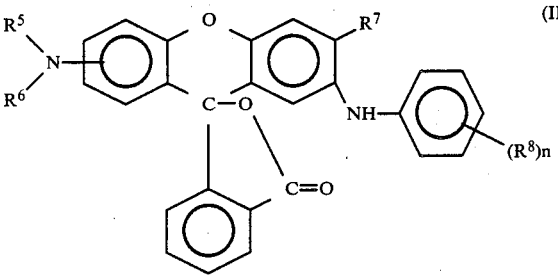

wherein $R^5$ and $R^6$ each represent an alkyl group having 1 to 8 carbon atoms, a cyclic hydrocarbon group having 1 to 8 carbon atoms, said alkyl group and said cyclic hydrocarbon groups can contain 1 to 3 ether bondings therein, $R^7$ represents hydrogen, an alkyl group having 1 to 2 carbon atoms, or halogen, $R^8$ represents hydrogen, an alkyl group having 1 to 6 carbon atoms, or halogen, and n represents an integer of 0, 1 to 5.

3. A thermosensitive recording material as claimed in claim 1, wherein said leuco dye is selected from the group consisting of the fluoran compounds having general formula,

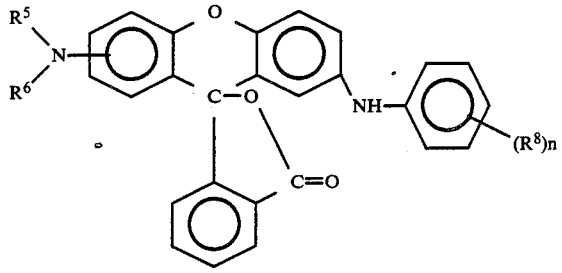

wherein $R^5$ and $R^6$ each represent an alkyl group having 1 to 6 carbon atoms, $R^8$ represents an alkyl group having 1 to 2 carbon atoms, and n is an integer of 0, 1 or 2.

4. A thermosensitive recording material as claimed in claim 1, further comprising a phenolic compound which serves as an auxiliary sensitizer for color development, said phenolic compound being selected from the group consisting of:

(1) the phenolic compounds having formula (I),

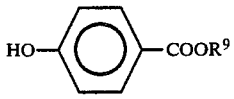

wherein $R^9$ represents an alkyl group having 1 to 7 carbon atoms, an unsubstituted or substituted phenyl group, or an unsubstituted benzyl group;

(2) the phenolic compounds having formula (II),

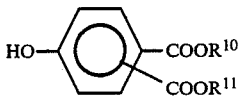

wherein $R^{10}$ and $R^{11}$ each represent an alkyl group having 1 to 7 carbon atoms, an unsubstituted or substituted phenyl group, or an unsubstituted or substituted benzyl group and $R^{10}$ and $R^{11}$ can be the same or different; and (3) the phenolic compounds having formula (III),

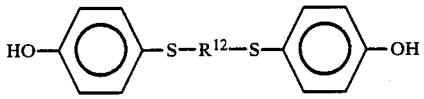

wherein $R^{12}$ represents an alkylene group having 2 to 10 carbon atoms, the alkylene group containing 1 to 3 ether bonds.

5. A thermosensitive recording material as claimed in claim 4, wherein the amount of said phenolic compound is in the range of $\frac{1}{3}$ to 10 times the amount of said zinc thiocyarate antipyrine complex in terms of parts by weight.

6. A thermosensitive recording material as claimed in claim 1, further comprising a diester compound which serves as an auxiliary sensitizer agent for color development, said diester compound being selected from the group consisting of (1) the diester compounds having formula (I),

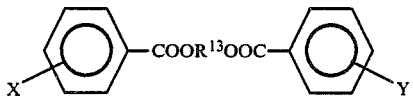

(I)

wherein $R^{13}$ represents an alkylene group, a cyclo-alkylene group, a substituted or unsubstituted arylene group, or $-R^{16}-Ar-R^{17}-$(in which $R^{16}$ and $R^{17}$ each represent a lower alkyl group and Ar represents an unsubstituted or substituted arylene group), X and Y each represent hydrogen, a lower alkyl group, halogen or an alkoxy group, and X and Y can be the same or different, and (2) the diester compounds having the general formula (II),

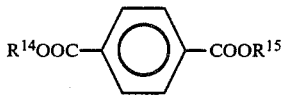

(II)

wherein $R^{14}$ and $R^{15}$ each represent an alkyl group, a cyclo-alkyl group, a substituted or unsubstituted aryl or aralkyl group, and $R^{14}$ and $R^{15}$ can be the same or different.

7. A thermosensitive recording material as claimed in claim 6, wherein the amounts of said leuco dye, said zinc thiocyanate antipyrine complex, and said diester compound are respectively in the range of 5 to 40 wt. %, in the range of 20 to 60 wt. % and in the range of 20 to 60 wt. %.

8. A thermosensitive recording material as claimed in claim 1, wherein the amount of said zinc thiocyanate antipyrine complex is in the range of 1 to 6 times the amount of said leuco dye in terms of parts by weight.

9. In a thermosensitive recording material comprising a support, a thermosensitive recording layer on said support, said thermosensitive recording layer containing a colorless or light-colored leuco dye and a color developer capable of inducing color formation in said colorless or light-colored leuco dye upon application of heat thereto, the improvement wherein said color developer is a zinc thiocyanate antipyrine complex of the formula

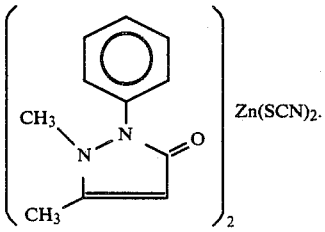

10. A thermosensitive recording material as claimed in claim 9 in which said thermosensitive recording layer comprises a first sub-layer containing said colorless or light-colored leuco dye and a second sub-layer containing said color developer, one of said sub-layers being overlaid on the other of said sub-layers.

* * * * *